US008396401B2

(12) United States Patent
Akedo

(10) Patent No.: US 8,396,401 B2
(45) Date of Patent: Mar. 12, 2013

(54) DEVELOPING DEVICE WITH AN ANTI-ACCUMULATION SECTION AND IMAGE FORMING APPARATUS INCLUDING THE SAME

(75) Inventor: Shuichi Akedo, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 245 days.

(21) Appl. No.: 12/830,567

(22) Filed: Jul. 6, 2010

(65) Prior Publication Data

US 2011/0052271 A1 Mar. 3, 2011

(30) Foreign Application Priority Data

Aug. 26, 2009 (JP) ..... 2009-196031

(51) Int. Cl.
*G03G 15/08* (2006.01)

(52) U.S. Cl. ..... 399/274

(58) Field of Classification Search ..... 399/274, 399/284

See application file for complete search history.

(56) References Cited

U.S. PATENT DOCUMENTS

| | | | | |
|---|---|---|---|---|
| 4,615,608 | A * | 10/1986 | Mizutani | 399/103 |
| 4,838,200 | A * | 6/1989 | Hosoi et al. | 399/104 |
| 4,916,492 | A * | 4/1990 | Hoshika et al. | 399/272 |
| 6,137,980 | A * | 10/2000 | Lee | 399/274 |
| 2007/0025777 | A1 * | 2/2007 | Tomita et al. | 399/274 |
| 2010/0111575 | A1 * | 5/2010 | Thompson et al. | 399/274 |

FOREIGN PATENT DOCUMENTS

| | | |
|---|---|---|
| JP | 04-034582 | 2/1992 |
| JP | 10-026878 | 1/1998 |
| JP | 2006-301463 | 11/2006 |
| JP | 2007-147915 | 6/2007 |

* cited by examiner

*Primary Examiner* — Quana M Grainger
(74) *Attorney, Agent, or Firm* — Nixon & Vanderhye P.C.

(57) ABSTRACT

An anti-accumulation section is provided at a section where an inner surface of a developer container abuts a surface of a doctor blade on an upstream side of a rotation direction of a developing roller. An angle between a surface of the anti-accumulation section facing the developing roller and the surface of the doctor blade on the upstream side of the rotation direction of the developing roller is set to be larger than an angle between a circle concentric with a cross section of the developing roller perpendicular to an extending direction of the developing roller and the surface of the doctor blade on the upstream side of the rotation direction of the developing roller at the section where the surface of the anti-accumulation section facing the developing roller and the surface of the doctor blade on the upstream side of the rotation direction of the developing roller abut. This realizes, with a simple configuration, a developing device capable of forming images of high quality without nonuniform development.

15 Claims, 10 Drawing Sheets

FIG. 11

| | SHAPES OF ANTI-ACCUMULATION SECTION AND DOCTOR BLADE | | | | OCCURRENCE OF NONUNIFORM DEVELOPMENT | | |
|---|---|---|---|---|---|---|---|
| | | | | | NORMAL TEMPERATURE AND NORMAL HUMIDITY | HIGH TEMPERATURE AND HIGH HUMIDITY | HIGH TEMPERATURE AND HIGH HUMIDITY |
| | θ (°) | h1 (mm) | hd (mm) | w1 (mm) | TONER DENSITY 7% | TONER DENSITY 7% | TONER DENSITY 8% |
| COMPARATIVE EXAMPLE | 90 | 0 | 2.2 | 0 | ◎ | △ | × |
| EXAMPLE1 | 94 | 0.5 | 1.7 | 7.1 | ◎ | ○ | × |
| EXAMPLE2 | 101 | 0.5 | 1.7 | 2.5 | ◎ | ○ | × |
| EXAMPLE3 | 96.5 | 0.8 | 1.4 | 7.1 | ◎ | ○ | ○ |
| EXAMPLE4 | 107.3 | 0.8 | 1.4 | 2.5 | ◎ | ○ | ○ |
| EXAMPLE5 | 98 | 1.2 | 1.0 | 7.1 | ◎ | ◎ | ◎ |
| EXAMPLE6 | 111.2 | 1.2 | 1.0 | 2.5 | ◎ | ◎ | ◎ |
| EXAMPLE7 | 102 | 1.5 | 0.7 | 7.1 | ◎ | ◎ | ◎ |
| EXAMPLE8 | 120.8 | 1.5 | 0.7 | 2.5 | ◎ | ◎ | ◎ |

DEVELOPING DEVICE WITH AN ANTI-ACCUMULATION SECTION AND IMAGE FORMING APPARATUS INCLUDING THE SAME

This Nonprovisional application claims priority under 35 U.S.C. §119(a) on Patent Application No. 2009-196031 filed in Japan on Aug. 26, 2009, the entire contents of which are hereby incorporated by reference.

TECHNICAL FIELD

The present technology relates to a developing device included in an electrophotographic image forming apparatus and to an image forming apparatus including the developing device.

BACKGROUND ART

An electrophotographic image forming apparatus generally has an advantage that it is able to easily form an image of good quality. Thus, electrophotographic image forming apparatus has wide applications including, for example, copying machines, printers, facsimile machines, and complex machines.

Such an image forming apparatus forms an image on a recording material through a charging step of charging the surface of a photoreceptor; an exposure step of exposing the charged surface of the photoreceptor correspondingly to image data so as to form an electrostatic latent image; a developing step of developing the electrostatic latent image with use of toner; a transfer step of transferring the developed toner image to a recording material; and a fixing step of fixing to the recording material the toner image transferred to the recording material.

Developers used in such an electrophotographic image forming apparatus are: single component developers containing only toner; and two-component developers having toner and carrier mixed therein. In general, the two-component developers are frequently used, because they are capable of forming a high-resolution image.

In the image forming apparatus using the two-component developers, the toner and the carrier are stirred in a developer container so as to cause the toner to be triboelectrically charged. The triboelectrically charged toner is adhered to a rotative developing roller and carried to a surface of the developing roller facing an image bearing member, so that the electrostatic latent image on the image bearing member is developed by the toner. Furthermore, the toner density in the developer container is measured. If the toner is insufficient, the developer container is supplied with the toner. In this way, the toner density in the developer container is maintained at a constant level.

For example, Patent Literature 1 discloses the arrangement in which a spike cutting plate (doctor blade) is provided at a brim of the developer container so as to face the developing roller. Such an arrangement aims to reduce difference between the result of the measurement of magnet permeability of the developer and the actual toner density. The difference is caused by variations in density of the developer as a whole. The spike cutting plate causes the developer absorbed by the developing roller to have a uniform height that is a distance from the surface of the developing roller. Here, the distance (doctor gap) between the spike cutting plate and the developing roller is made variable. Further, Patent Literature 1 discloses the arrangement in which two screws are disposed in parallel with the developing roller for stirring and circulating the developer in the developer container. A toner density sensor is provided close to one of the screws that is disposed farther from the developing roller than the other.

CITATION LIST

Patent Literature 1

Japanese Patent Application Publication Tokukaihei No. 4-34582 A (1992) (Publication Date: Feb. 5, 1992).

SUMMARY OF TECHNOLOGY

Technical Problem

However, the technique of Patent Literature 1 has a problem that the developer is accumulated at the base of the spike cutting plate. In consequence, part of the accumulated developer ununiformly passes through the space between the spike cutting plate and the developing roller, which results in the occurrence of nonuniform development. More specifically, in the conventional technique, the bottom surface (inner surface) of the developer container is configured such that part thereof facing the developing roller has a shape corresponding to the shape of the developing roller. In other words, the part of the bottom surface of the developer container has a shape that is almost concentric with a cross section of the developing roller in a direction perpendicular to the axial direction of the developing roller. The spike cutting plate is provided to project from the bottom surface of the developer container. As such, the developer accumulates in the proximity of the boundary section between the bottom surface of the developer container and the spike cutting plate. Then, the rotation of the developing roller causes part of the accumulated developer to ununiformly scrape through the space between the spike cutting plate and the developing roller.

Moreover, as a result of the accumulation of the developer, heat generated by the friction between the developer and the developing roller is trapped in the proximity of the boundary section where the developer accumulates, thereby causing a rise in temperature of the developer. Consequently, the developer becomes easily fused to the developing roller. This results in degradation in image quality.

Furthermore, the technique of Patent Literature 1 requires a locomotive mechanism for causing the spike cutting plate to move relatively to the developing roller. As such, the problems arise: a complicated configuration of the device; and the need for maintenance of the locomotive mechanism. In addition, in the technique of Patent Literature 1, the toner density sensor is positioned away from the spike cutting plate. This causes an additional problem of low responsivity in controlling the toner density.

The present technology is accomplished in view of the foregoing problems, and an object thereof is to realize a developing device, with a simple configuration, capable of forming an image of high quality without nonuniform development.

Solution to Problem

In order to attain the above object, a developing device according to the present technology includes a developer container containing a developer; and a developing roller being provided so that a peripheral surface thereof is partially exposed to an outside of the developer container through an opening provided in the developer container, the developing roller being rotated while the developer contained in the developer container is adhered to the developing roller, so that the developer is carried to the outside of the developer container, the developing roller being rotated in such a manner that the peripheral surface thereof passes close by an end of the opening on a bottom-surface side of the developer container to the outside of the developer container, and passes close by an end of the opening on a ceiling side of the developer container to the inside of the developer container, and the developing device according to the present technology further includes: a doctor blade, provided at the end of the opening on the bottom-surface side of the developer container so as to project from the developer container toward the developing roller, regulating a height of a layer of the developer adhered to the developing roller to be carried, the height being a distance from the peripheral surface of the developing roller; and an anti-accumulation section provided at a corner formed between an inner surface of the developer container and a surface of the doctor blade on an upstream side of a rotation direction of the developing roller, and in the developing device according to the present technology, an angle between a surface of the anti-accumulation section facing the developing roller and a surface of the doctor blade on the upstream side of the rotation direction of the developing roller is larger than an angle between a circle concentric with a cross section of the developing roller perpendicular to a direction in which the developing roller extends and the surface of the doctor blade on the upstream side of the rotation direction of the developing roller at the corner.

According to the above configuration, the anti-accumulation section is provided at the corner formed between the inner surface of the developer container and the surface of the doctor blade on the upstream side of the rotation direction of the developing roller, and the angle between the surface of the anti-accumulation section facing the developing roller and the surface of the doctor blade on the upstream side of the rotation direction of the developing roller is larger than the angle between the circle concentric with the cross section of the developing roller perpendicular to the direction in which the developing roller extends and the surface of the doctor blade on the upstream side of the rotation direction of the developing roller at the corner. This makes it possible to curb the accumulation of the developer dammed by the doctor blade as well as to prevent the occurrence of an unstable density of the developer carried to the outside of the developer container due to uneven passage of the dammed developer through the space between the doctor blade and the developing roller. Furthermore, it is also prevented that the accumulation of the developer causes the temperature of the developer in the proximity of the doctor blade to rise and that the developer thus becomes more likely to be fused to the developing roller. As a result, it is possible to stabilize the density of the developer carried by the developing roller to the outside of the developer container and form an image of high quality with little nonuniform development.

According to the above configuration, the developing roller is rotated in such a manner that the peripheral surface thereof passes close by an end of the opening on the bottom-surface side of the developer container to the outside of the developer container, and passes close by an end of the opening on the ceiling side of the developer container to the inside of the developer container. In this configuration, in comparison with the configuration in which the developing roller is rotated in a counter direction, the developer dammed by the doctor blade, which is provided in the proximity of the end of the opening on a bottom-surface side of the developer container, is particularly likely to accumulate. Nevertheless, the present technology can effectively curb the accumulation of the developer dammed by the doctor blade.

Advantageous Effects of Technology

As described above, the developing device according to the present technology is such that an anti-accumulation section is provided at a corner formed between an inner surface of the developer container and a surface of the doctor blade on an upstream side of a rotation direction of the developing roller, and an angle between a surface of the anti-accumulation section facing the developing roller and the surface of the doctor blade on the upstream side of the rotation direction of the developing roller is larger than an angle between a circle concentric with a cross section of the developing roller perpendicular to a direction in which the developing roller extends and the surface of the doctor blade on the upstream side of the rotation direction of the developing roller at the corner.

It is therefore possible to stabilize the density of the developer carried by the developer to the outside of the developer container and to thus form an image of high quality with little nonuniform development.

BRIEF DESCRIPTION OF DRAWINGS

FIG. 9(*b*) is a graph showing results of toner density measurements in the developing device according to the example shown in FIG. 7.

FIG. 11 is a table showing results of experiments carried out to evaluate, in a developing device according to an embodiment of the present technology, relations between the shape of the anti-accumulation section and nonuniform development as well as relations between an ambient temperature and humidity and nonuniform development.

DESCRIPTION OF EMBODIMENTS

An embodiment of the present technology is now explained. In the present embodiment, a case is described where the present technology is applied to a color printer that forms, on paper P serving as a recording material (transfer-receiving material), a color image or a monochrome image as an image corresponding to image data transmitted from various devices (not illustrated), such as a scanner and a PC (Personal Computer), that are communicably connected to the color printer. However, the application target of the present technology is not limited to the color printer. The present technology may be applied to various electrophotographic image forming apparatuses such as a monochrome printer, a color multifunction printer, a monochrome multifunction printer, a facsimile apparatus, a color copying machine, and a monochrome copying machine.

(1-1. Configuration of Color Printer)

Figure 2:
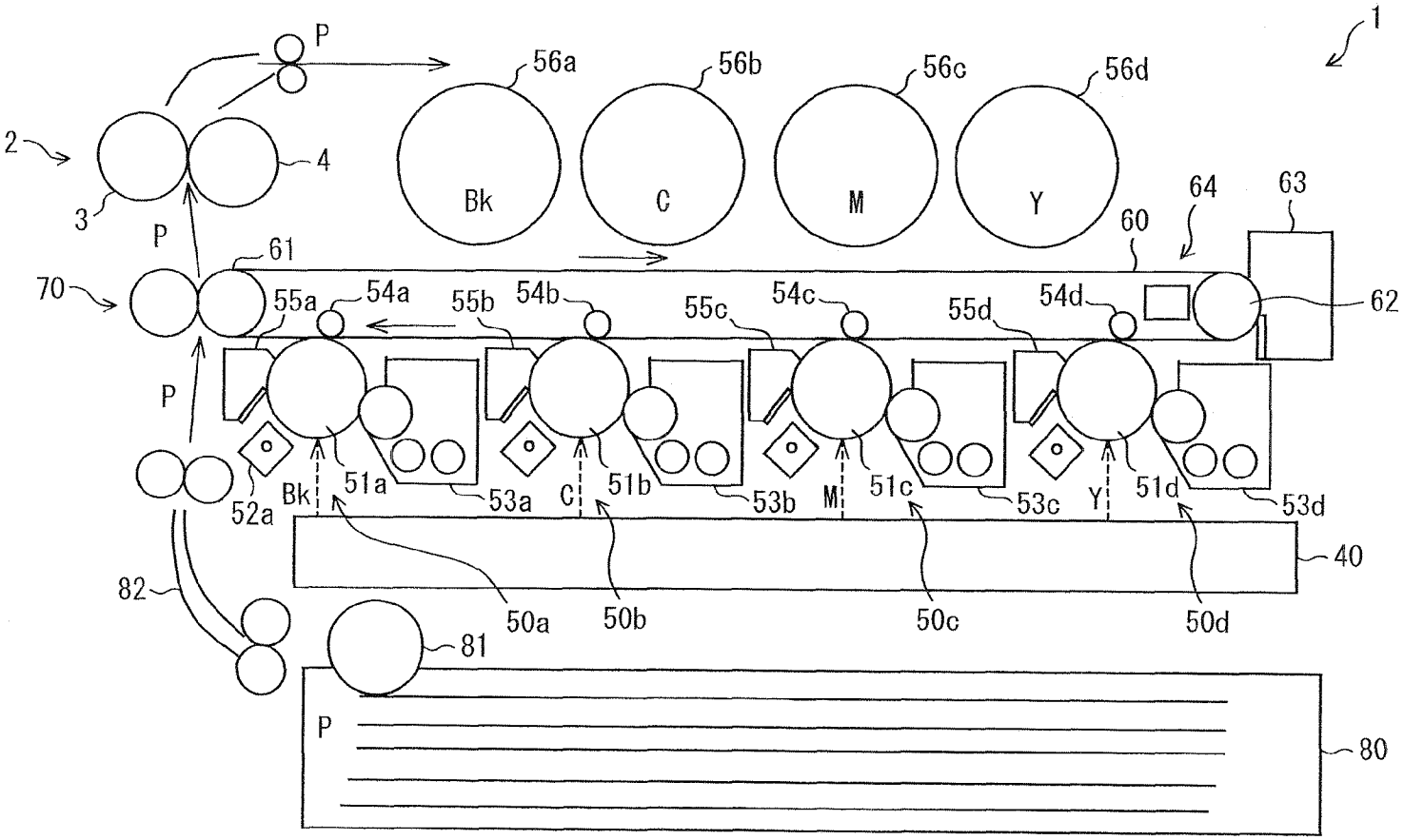
FIG. 2 is a cross-sectional view of an image forming apparatus including developing devices according to an embodiment of the present technology.

FIG. 2 is a cross-sectional view of a color printer (image forming apparatus) 1 according to the present embodiment. As illustrated in FIG. 2, the color printer 1 includes: four visible image forming units 50*a* to 50*d*; an intermediate transfer unit 64 having an intermediate transfer belt 60; a second transfer unit 70; a fixing unit 2; and an internal paper feeding unit 80. The components included in the color printer 1 each operates under control of a main control section (not illustrated) realized by a CPU or the like.

The visible image forming units 50*a* to 50*d* respectively form black (K), cyan (C), magenta (M), and yellow (Y) toner images, and transfer the toner images onto the intermediate transfer belt 60 so that these toner images overlap each other.

The visible image forming unit 50*a* is configured such that a charging unit 52*a*, a developing unit 53*a*, a first transfer unit 54*a*, and a cleaning unit 55*a* are arranged in this order around a rotative photoreceptor drum (toner image bearing member) 51*a* along the rotation direction thereof.

The photoreceptor drum (image bearing member) 51 is formed of a nearly cylindrical drum having a photosensitive material such as an OPC (Organic PhotoConductor) on the surface thereof. The photoreceptor drum 51 is disposed above an exposure device 40 and controlled by driving means and control means (both not illustrated) so as to be driven to rotate in a predetermined direction (in FIG. 2, counterclockwise). The present embodiment uses a photoreceptor drum 51 of 30 mm in diameter. However, this is not the only possibility. As described later, the processing speed of the color printer 1 varies depending on whether it operates in a color mode or a monochrome mode. The photoreceptor drum 51 is driven to rotate at a speed of 122 mm/sec in the color mode, and at a speed of 145 mm/sec in the monochrome mode.

The charging unit 52*a* uniformly charges the surface of the photoreceptor drum 51*a* so that the surface of the photoreceptor drum 51*a* has a predetermined potential. In the present embodiment, a charging unit of a charging roller type (contact charging type) is used as the charging unit 52*a*. However, the configuration of the charging unit 52*a* is not limited thereto. For example, the charging unit 52*a* may be a non-contact charging device of a corona discharge type or the like type or a contact charging device of a brush charging type or the like type.

The exposure device 40 exposes, correspondingly to the image data, the surfaces of the photoreceptor drums 51*a* to 51*d* charged by the charging units 52*a* to 52*d*, so that electrostatic latent images corresponding to the image data are formed on the surfaces of the photoreceptor drums 51*a* to 51*d*, respectively. As the exposure device 40, for example, a laser scanning unit (LSU) including a laser radiation section and a reflection mirror, a writing device (for example, a writing head) in which light-emitting elements such as ELs or LEDs are arranged in an array, or the like may be used.

The developing unit (developing device) 53*a* performs a developing process for making the electrostatic latent image formed on the photoreceptor drum 51*a* visible by use of a two-component type developer containing toner and carrier. The details of the developing unit 53*a* will be described later.

The color printer 1 is equipped with toner bottles 56*a* to 56*d* of the respective colors at the top thereof, as illustrated in FIG. 2. In a case where the toner densities in the developer containers included in the developing units 53*a* to 53*d* decrease, the toner containers are supplied with toner as necessary from the toner bottles 56*a* to 56*d* via toner hoppers and supplying means such as toner carrier pipes (both not illustrated). The toner hoppers can contain a large amount of supplemental toner. As such, even when the supplemental toner in the toner bottles 56*a* to 56*d* run out, the toner hoppers contain toners in large quantity. Therefore, the color printer 1 can operate without a rest due to shortage of toner. In the meantime, the empty toner bottles can be replaced with the new ones.

Each of the first transfer units 54*a* to 54*d* is disposed at a position between a section where the photoreceptor drums 51*a* to 51*d* are opposed to the developing units 53*a* to 53*d* and a section where the photoreceptor drums 51*a* to 51*d* face the cleaning units 55*a* to 55*d*. In this way, the first transfer units 54*a* to 54 are respectively opposed to the photoreceptor drums 51*a* to 51*d* with the intermediate transfer belt 60 provided therebetween. When a high voltage of a polarity (+) opposite to a charged polarity (−) of the toners is applied to the first transfer units 54*a* to 54*d*, the toner images on the photoreceptor drums 51*a* to 51*d* are transferred onto the intermediate transfer belt 60 so as to overlap each other.

The cleaning unit 55*a* causes a cleaning blade made of polyurethane rubber to abut the surface of the photoreceptor drum 51*a* so as to remove and collect the toner remaining on the surface of the photoreceptor drum 51*a* after the transfer of the toner image to the intermediate transfer belt 60.

Note that the visible image forming units 50*b* to 50*d* have substantially the same configurations as the visible image forming unit 50*a*, except that the colors of the toners used for developing processes are different, respectively. In other words, the developing units of the visible image forming units 50*a* to 50*d* respectively contain black (B) toner, yellow (Y) toner, magenta (M) toner, and cyan (C) toner.

The intermediate transfer unit 64 includes: an intermediate transfer belt 60; an intermediate transfer belt driving roller (a tension roller) 61; an intermediate transfer belt driven roller (a tension roller) 62; and an intermediate transfer belt cleaning unit 63.

The intermediate transfer belt 60 is an endless belt made of a semi-conductive polyimide, and is driven to rotate about the intermediate transfer belt driving roller 61 and the intermediate transfer belt driven roller 62. The toner images of the respective colors formed on the photoreceptor drums 51*a* to 51*d* are sequentially transferred to the intermediate transfer belt 60 so as to overlap each other. As a result, a color toner image (multicolor toner image) is formed on the intermediate transfer belt 60.

The toner image formed on the intermediate transfer belt 60 is carried to an area where the intermediate transfer belt driving roller 61 and the second transfer unit 70 face each other, and is then transferred onto the recording material, such as recording paper, carried to such an area. Specifically, the toner image on the intermediate transfer belt 60 is transferred onto the recording paper by applying to the second transfer unit 70 a potential of a polarity opposite to the polarity of the toner so that the toner is attracted to the second transfer unit 70. The intermediate transfer belt cleaning unit 63 causes a cleaning blade made of urethane rubber to abut the intermediate transfer belt 60, thereby removing and collecting the toner remaining on the intermediate transfer belt 60 after the transfer of the toner image to the recording material.

A fixing unit (fixing device) 2 includes a fixing roller 3 and a pressure roller 4 that is pressed with a predetermined load to the fixing roller 3. The fixing unit 2 is disposed downstream of the second transfer unit 70 along a carrying direction of the recording material. The fixing unit 2 feeds the recording material, onto which the toner image has been transferred by the second transfer unit 70, to a nip area (fixing nip area) where the fixing roller 3 and the pressure roller 4 are pressed to each other, thereby causing the recording material to pass through the pressure area so that the toner image is fixed to the recording material by heat and pressure. Note that the surface of the recording material on which an unfixed toner image is formed abuts the fixing roller 3, while the opposite surface of the recording material abuts the pressure roller 4.

An internal paper feeding unit 80 stores recording materials to be used for image forming.

The color printer 1 is further provided with a paper carrying path 82 for carrying the recording materials fed by the feed roller 81 from the internal paper feeding unit 80 via the second transfer unit 70 and the fixing unit 2 to a paper output tray (not illustrated). The paper carrying path 82 is provided with a number of roller members for carrying the recording materials.

The operations of the foregoing components are controlled by a control section (not illustrated) included in the color printer 1. The color printer 1 operates at different paper carrying speeds (processing speeds) depending on whether it is in a color mode for printing a colored image or a monochrome mode for printing a monochrome image. Specifically, in the color mode, the color printer 1 is set to carry paper at such a speed that, in a case where A4 sized paper is fed in landscape orientation (shorter edges of the A4 sized paper sheets point in the direction in which the paper is fed), 26 sheets of paper can be printed per minute (122 mm/sec). In the monochrome mode, the color printer 1 is set to carry paper at such a speed that, in a case where A4 sized paper sheets are fed in landscape orientation, 31 sheets of paper can be printed per minute (145 mm/sec).

(1-2. Configuration of Developing Device)

Figure 3:
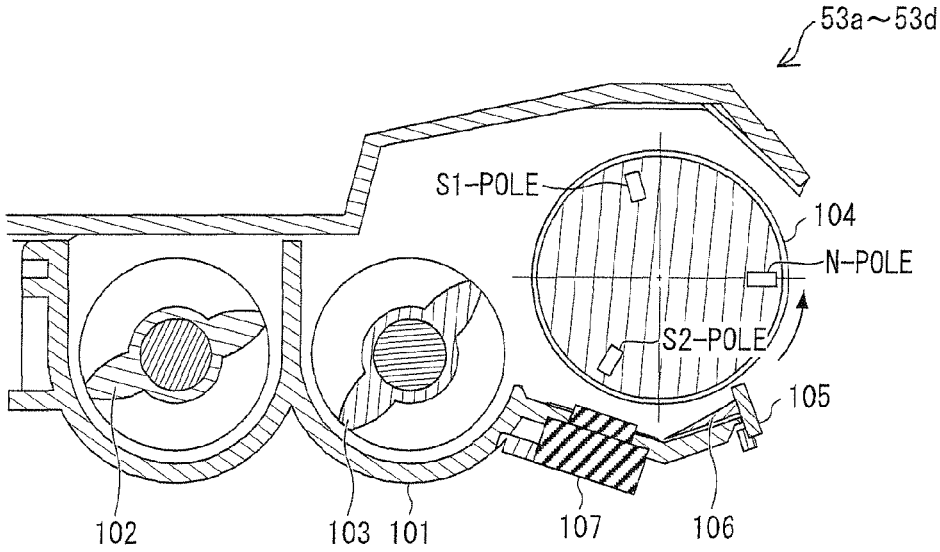
FIG. 3 is a cross-sectional view of a developing device according to an embodiment of the present technology.

FIG. 3 is a cross-sectional view of the developing unit 53*a*. Note that a configuration of the developing unit 53*a* will be herein described, but configurations of the developing units 53*b* to 53*d* are substantially the same as the configuration of the developing unit 53*a*.

As illustrated in FIG. 3, the developing unit 53*a* includes a developer container 101; a first carrying screw 102; a second carrying screw 103; a developing roller 104; a doctor blade 105; an anti-accumulation section 106; and a toner density sensor 107.

The developer container 101 is a container for containing a developer. In the present embodiment, a two-component developer containing toner and carrier is used as the developer.

As the toner, conventionally well-known toner containing a binder resin, a colorant, a wax (a releasing agent), an external additive, and the like can be used. A toner additive such as a charge control agent may further be contained. As the binder resin, for example, a binder resin for black toner or a binder resin for color toner is used. Examples of the binder resin include a polyester-based resin, styrene-based resins such as polystyrene and styrene-acrylic ester copolymer resin, acrylic resins such as polymethylmethacrylate, polyolefin-based resins such as polyethylene, polyurethane, and an epoxy resin. Examples of the colorant include a yellow toner colorant, a magenta toner colorant, a cyan toner colorant, and a black toner colorant. Examples of the releasing agent include: a petroleum wax such as a paraffin wax and its derivative and a microcrystalline wax and its derivative; a hydrocarbon-based synthetic wax such as a Fischer-Tropsch wax and its derivative, a polyolefin wax and its derivative, a low-molecular polypropylene wax and its derivative, and a polyolefin polymer wax and its derivative; a carnauba wax and its derivative; and an ester-based wax. It is preferable that the content of the releasing agent be in a range from 1.5% to 5% by weight with respect to the total weight of the toner. Examples of the external additive include a silica fine powder, a titanium oxide fine powder, and an alumina fine powder. The toner used in the present embodiment is the one that is manufactured by a pulverization technique and has a volume average particle size in the range from 5.0 μm to 7.0 μm. Note that the toner to be used are not limited to those manufactured by a pulverization technique, but toners manufactured by a suspension polymerization method, an emulsion polymerization method (emulsion polymerization association method), a dissolution suspension method, an ester tension suspension polymerization method, and the like may also be used.

As the carrier, magnetic particles of metals such as iron, ferrite, and magnetite or alloys of these metals and aluminum, lead, or the like may be used. The carrier to be used may also be a resin-coated carrier obtained by coating magnetic particles with a resin, a dispersed-in-resin carrier obtained by dispersing magnetic particles in a resin, or the like. Further, it is preferable that the shape of the carrier be spherical or oblong. In the present embodiment, a ferritic core carrier having a volume average particle size of 45 μm is used. Moreover, in the present embodiment, a two-component developer is used in which carrier and toner are mixed in such a manner that the coverage of the toner over the carrier is 60%.

The first carrying screw 102 and the second carrying screw 103 stir and mix the developer in the developer container 101 so that the toner is charged.

Figure 4:
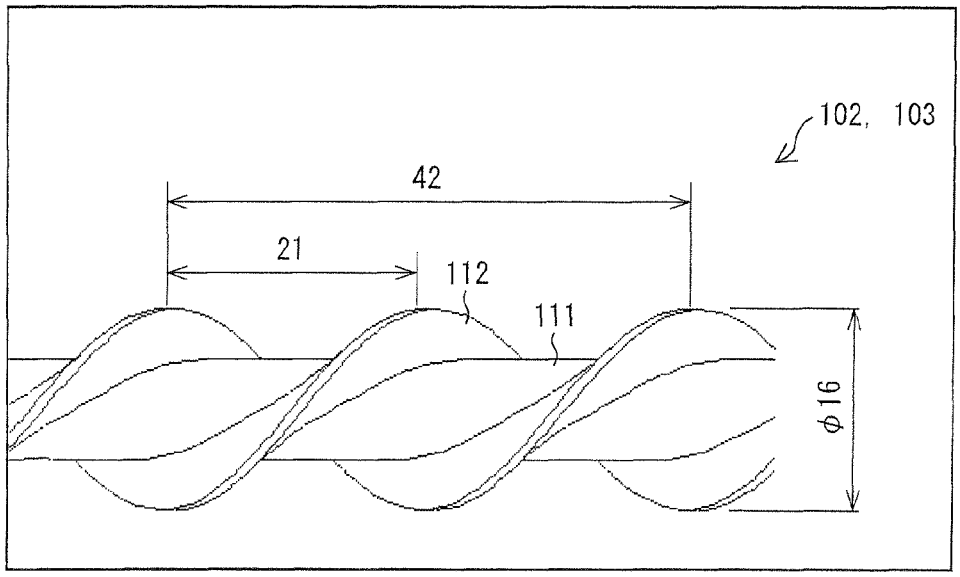
FIG. 4 is a plan view illustrating part of a carrying screw included in the developing device of FIG. 3.

FIG. 4 is a plan view illustrating part of the first carrying screw 102 and the second carrying screw 103. As illustrated in FIG. 4, the first carrying screw 102 and the second carrying screw 103 each includes a cylindrical or columnar shaft 111 and a blade 112 formed on the peripheral surface of the shaft 111. In the present embodiment, the shaft 111 and the blade 112 are made of nonmagnetic stainless steel. The shaft 111 has an external diameter of 8 mm, and the blade 112 has an external diameter of 16 mm. On the outer peripheral surface of the shaft 111, two helical blades 112 are provided in such a manner that the respective tops of the ridges of the two blades 112 are separated by 21 mm from each other in the direction in which the screw extends. As to each of the blades, adjacent tops of the ridge are separated by 42 mm from each other.

As illustrated in FIG. 3, the first carrying screw 102 and the second carrying screw 103 are disposed substantially in parallel with each other. Between the first carrying screw 102 and the second carrying screw 103, a wall 101*a* is provided so as to project upwards from the bottom surface (inner surface) of the developer container 101 and to partition the region where the screws are provided.

Figure 5:
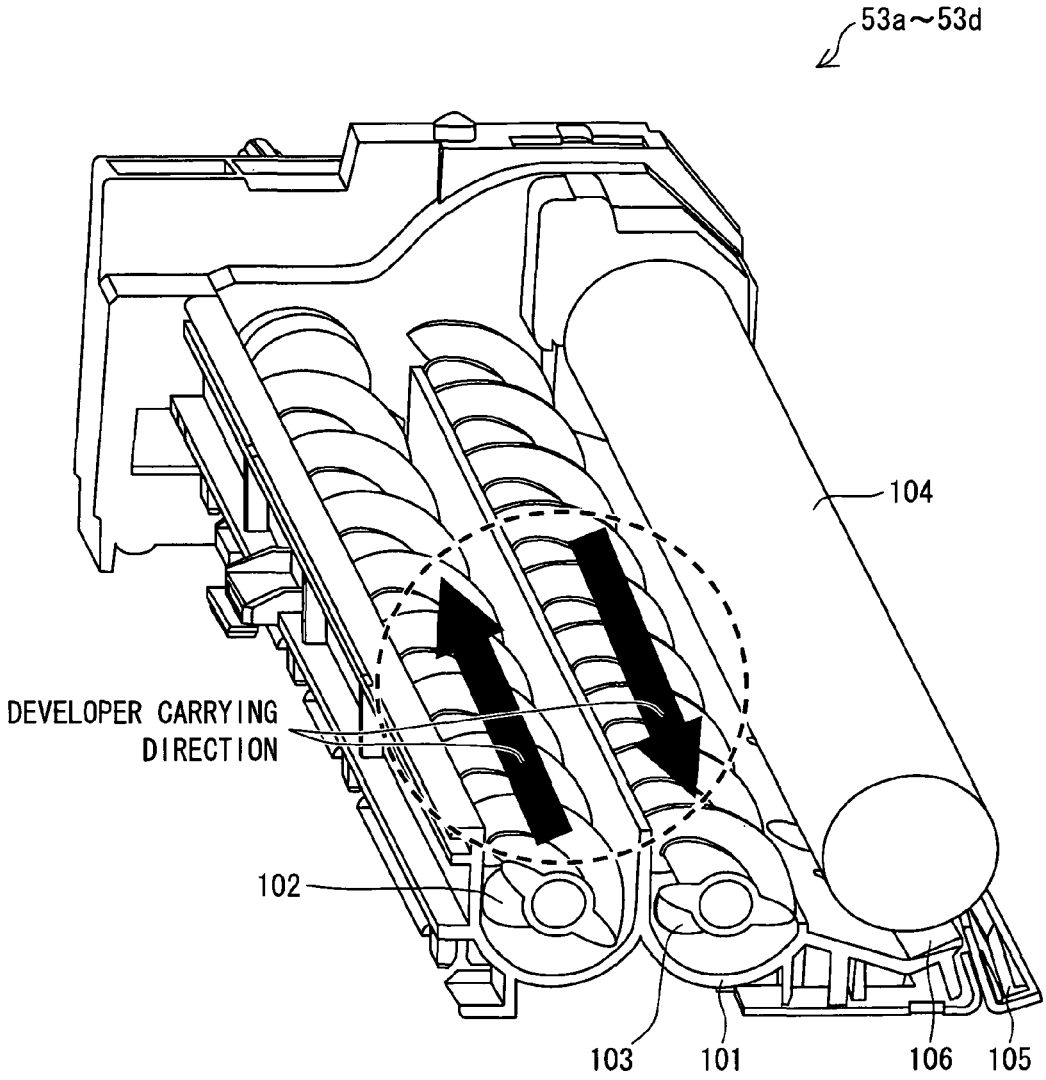
FIG. 5 is a perspective, cross-sectional view of the developing device illustrated in FIG. 3.
Figure 6:
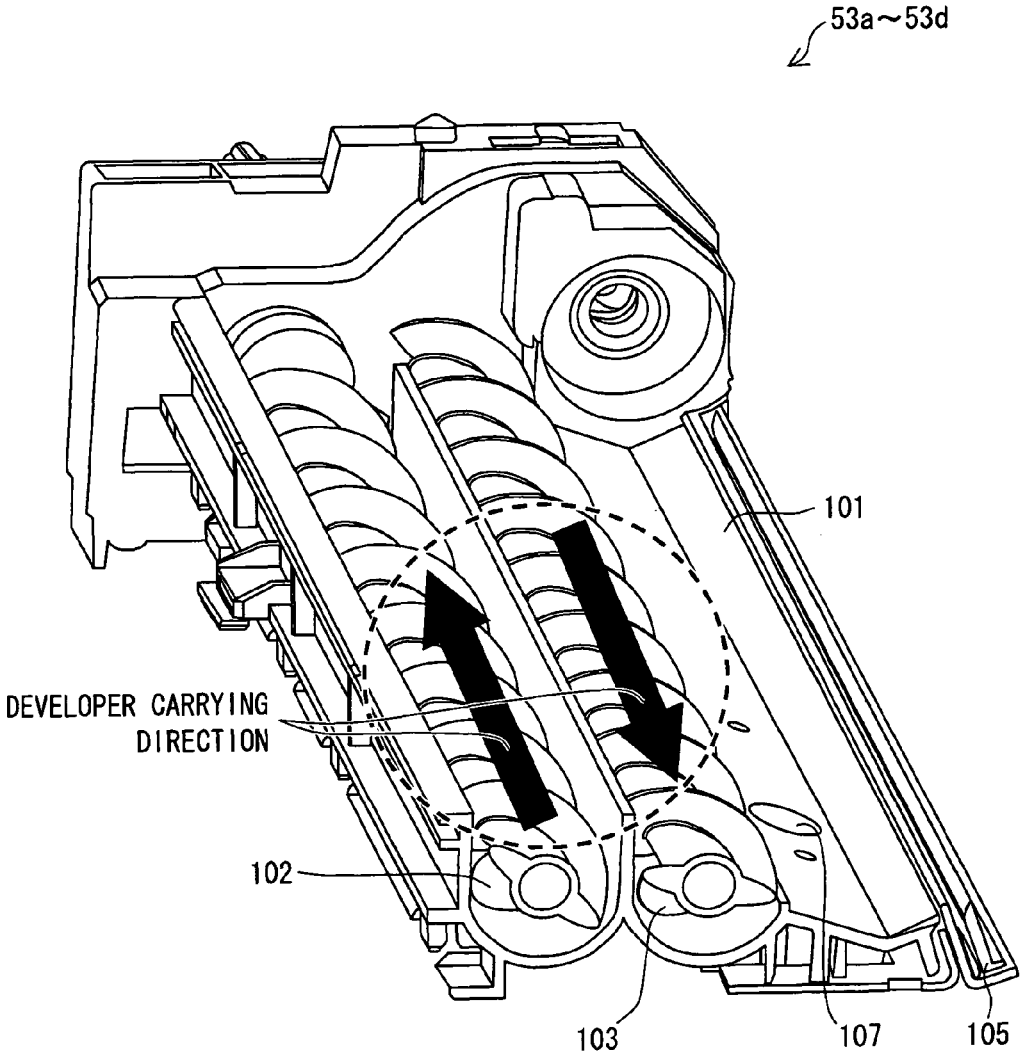
FIG. 6 is a perspective, cross-sectional view of the developing device illustrated in FIG. 5, wherein the developing roller is omitted.

FIG. 5 is a perspective, cross-sectional view of the developing unit 53*a*. FIG. 6 omits the developing roller 104 in the perspective, cross-sectional view of FIG. 5.

The first carrying screw 102 and the second carrying screw 103 are driven by driving means (not illustrated) such as a motor and gears to rotate about an axis that is the direction in which the shaft 111 extends. This causes the blade 112 to propagate the driving force to the developer so that the developer is carried. Specifically, the first carrying screw 102 and the second carrying screw 103 are driven to rotate at peripheral velocities (peripheral velocities measured with respect to the top of the ridge of the blade 112) of 277 mm/sec in the color mode and 337 mm/sec in the monochrome mode.

As illustrated in FIGS. 5 and 6, the first carrying screw 102 and the second carrying screw 103 are provided to carry the developer in opposite directions, respectively. For example, the first carrying screw 102 and the second carrying screw 103 may be arranged to rotate in opposite directions, or they may be arranged to rotate in the same direction but have opposite helical directions (revolving directions) of the blades 112. The wall 101*a* is configured such that it is cut out at the both ends in the axial direction of the first carrying screw 102 and the second carrying screw 103 (FIGS. 4 and 5 illustrate the cutout at only one of the two ends). Above and near the end of the first carrying screw 102 on the upstream side of the carrying direction of the developer, a supply opening (not illustrated) is provided through which the developer container 101 receives the toner supplied from the toner bottle 56*a* via supply means such as a toner hopper and a toner carrying pipe.

Consequently, the toner supplied through the supply opening and the developer previously contained in the developer container 101 are stirred and mixed as they are carried by the first carrying screw 102 along the direction in which the first carrying screw 102 extends. The developer carried by the first carrying screw 102 passes through one of the cutouts of the wall 101*a* and is then carried to the side of the second carrying screw 103. The developer is then carried by the second carrying screw 103 along the extending direction of the second carrying screw 103, thereby being further stirred and mixed. After that, the developer passes through the other cutout of the wall 101*a* and is then brought back to the side of the first carrying screw 102. Part of the developer carried by the second carrying screw 103 moves to the developing roller 104. The mixing and stirring by the first carrying screw 102 and the second carrying screw 103 causes the toner to be charged. The charged toner is adhered to the developing roller 104, carried to a section where the developing roller 104 faces the photoreceptor drum 51*a*, and then used for developing. The toner thus carried by the developing roller 104 to the area where the developing roller 104 faces the photoreceptor drum 51*a* but not used for developing is returned to the inside of the developer container 101. The unused toner is then separated from the developing roller 104 by the action of an S1-pole and the like provided inside the developing roller 104 that will be described later. The separated toner and the developer in the developer container 101 are stirred and mixed again by the second carrying screw 103.

The developing roller 104 is a hollow cylindrical roller member made of a nonmagnetic material, and part of a peripheral surface of the developing roller 104 is exposed to the outside of the developer container 101 through an opening provided in the developer container 101. The developing roller 104 is disposed such that the part exposed to the outside of the developer container 101 faces the photoreceptor drum 51*a*. The developing roller 104 is driven by driving means such as a motor and gears (not illustrated) to rotate in the direction indicated by an arrow shown in FIG. 3. That is, the developing roller 104 is driven to rotate in such a manner that the peripheral surface of the developing roller 104 passes close by an end of the opening on a bottom-surface side of the developer container 101 to the outside of the developer container 101, and passes close by an end of the opening on a ceiling side of the developer container 101 to the inside of the developer container 101. The material of the developing roller 104 is not particularly limited, and metal materials such as nonmagnetic stainless steel or aluminum, or resin materials such as an ABS resin may be used, for example. In addition, around the surface (outer peripheral surface) of the developing roller 104, a rubber layer made of a conductive rubber elastic material may be provided. The size of the developing roller 104 is not particularly limited. In the present embodiment, the developing roller 104 has an external diameter of 20 mm and is made of nonmagnetic stainless steel. The developing roller 104 is driven to rotate at peripheral velocities of 303 mm/sec in the color mode and 366 mm/sec in the monochrome mode.

Inside the developing roller 104 are provided a plurality of magnetic field generating means (magnetic poles) (an S1-pole, an S2-pole, and an N-pole), as illustrated in FIG. 3. These magnetic poles are fixed to a housing of the developing unit 53*a* (housing of the developer container 101). That is, the S1-pole, the S2-pole, and the N-pole do not rotate, but the developing roller 104 rotates around these magnetic poles.

The S2-pole is a magnetic pole that causes the triboelectrically charged toner to be adhered to the developing roller 104. The toner adhered to the developing roller 104 exhibits brush-like spikes and forms a toner brush (magnetic brush) on the outer peripheral surface of the developing roller 104.

The N-pole is a magnetic pole (main magnetic pole) disposed in the opening of the developer container 101 at a position facing the photoreceptor drum 51*a*. The N-pole causes the toner to be adhered to the surface of the photoreceptor drum 51*a* by rubbing the toner brush against the surface of the photoreceptor drum 51*a*, so that the electrostatic latent image on the photoreceptor drum 51*a* is developed (made visible).

The S1-pole is a magnetic pole that causes the toner which has been adhered to the developing roller 104 and returned to the inside of the developer container 101 to be separated from the developing roller 104, without contributing to developing.

Figure 1A:
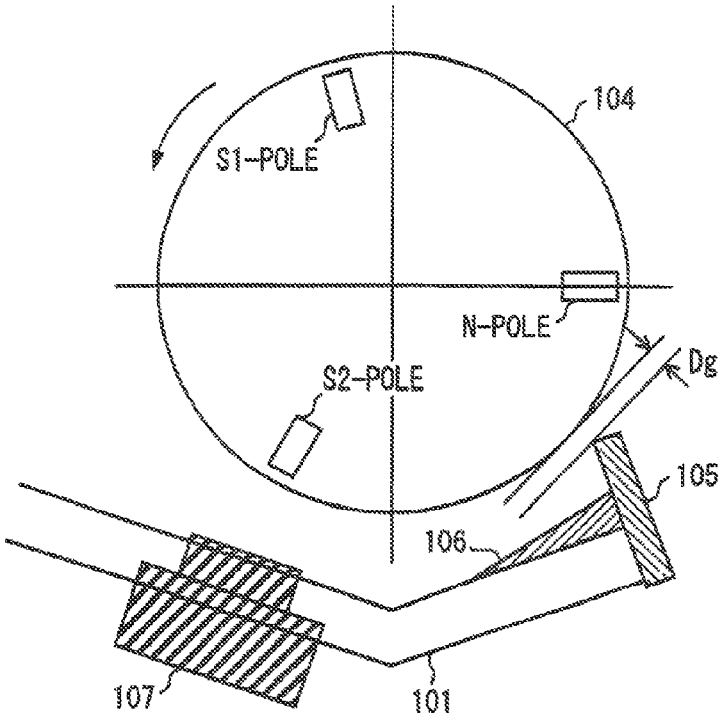
FIGS. 1A and 1B are cross-sectional views illustrating an essential part of a developing device according to two alternate embodiments of the present technology.

A toner density sensor 107 detects the density of the developer in the developer container 101. In the present embodiment, as illustrated in FIG. 1A, the toner density sensor 107 is positioned on a bottom surface (inner surface) of the developer container 101 so as to face the developing roller 104. The toner density sensor 107 is positioned upstream of the anti-accumulation section 106 along the rotation direction of the developing roller 104. Note that the configuration of the toner density sensor 107 is not particularly limited. For example, a conventionally known magnetic permeability sensor or the like may be used.

In the present embodiment, the toner density detection result obtained by the toner density sensor 107 is transmitted to the control section (not illustrated) of the color printer 1. In a case where the detected toner density is equal to or below a predetermined value, the control section controls the operations of the supply means such as a toner hopper and a toner carrying pipe so that toner is supplied in an amount corresponding to the toner density detection result from the toner bottle 56*a* to the developer container 101.

A doctor blade (developer layer thickness regulating plate) 105 is provided at the end of the opening of the developer container 101 on the upstream side of the rotation direction of the developing roller 104 (at the end of the opening on the bottom-surface side of the developer container 101). The doctor blade 105 is a platy member that cuts off spikes of part of the toner adhered to the developing roller 104 so as to regulate the height of the spikes of the toner (toner brush) carried to the area where the developing roller 104 and the photoreceptor drum 51*a* face each other. In other words, the doctor blade 105 regulates a doctor gap Dg, which is a gap between the developing roller 104 and an end of the doctor blade 105, thereby regulating the spike height of the toner (height of the layer of the developer) that passes through the doctor gap Dg.

In the present embodiment, the doctor gap Dg is set to be 1.5 mm. The size of the doctor gap Dg is not limited thereto, but preferably more than 1.0 mm and less than 1.8 mm. A too small doctor gap Dg causes difficulties for the toner adhered to the developing roller 104 in passing through the gap, which makes it impossible to provide sufficient toner to the photoreceptor drum 51*a*. On the other hand, a too big doctor gap Dg causes an excessive amount of the toner to be supplied to the photoreceptor drum 51*a*, which results in deterioration of image quality.

The anti-accumulation section 106 is provided to cover a part where the bottom surface (inner surface) of the developer container 101 abuts the surface of the doctor blade 105 on the upstream side of the rotation direction of the developing roller 104. Moreover, the anti-accumulation section 106 is provided such that an angle between the surface of the anti-accumulation section 106 facing the developing roller 104 and the surface of the doctor blade 105 on the upstream side of the rotation direction of the developing roller 104 is larger than an angle between the bottom surface of the developer container 101 and the surface of the doctor blade 105 on the upstream side of the rotation direction of the developing roller 104.

Moreover, as illustrated in FIG. 1A, the anti-accumulation section 106 is provided to face a section of the developing roller 104, and inside the section of the developing roller 104, no fixed magnetic pole is provided (i.e., the anti-accumulation section 106 is provided at a position facing a region located between the position of the S2-pole and the position of the N-pole). This makes it possible to curb the occurrence of consolidation and agglomeration of the developer. In the embodiment illustrated in FIG. 1A, the anti-accumulation section 106 is separate from, but attached to, the bottom surface of the developer container 101. In the embodiment illustrated in FIG. 1B, the anti-accumulation section 106 is integral with the developer container 101.

More specifically, the developer can easily be consolidated by its own weight in a region between the proximity of the magnetic pole (developer drawing pole) S2 and the doctor blade 105. Here, if a magnetic pole is provided at a position facing the anti-accumulation section 106, the agglomeration is more likely to occur. This is because the magnetic pole provided at the position facing the anti-accumulation section 106 forms a magnetic brush chain and thus increases a pressure of the developer against the anti-accumulation section 106, which causes consolidation of the developer between the magnetic brush chain and the anti-accumulation section 106. Note that the distance between the developing roller 104 and the anti-accumulation section 106 is relatively small. Therefore, the density of the magnetic brush chain itself increases, which causes consolidation and agglomeration of the developer more easily.

The consolidation and agglomeration of the developer is accompanied by defects including a nonuniform developer layer formed on the developing roller 104 and a low accuracy of the toner density sensor 107 in detecting the toner density. The above defects become prominent particularly at high temperature and high humidity. This is because at high temperature and high humidity the developer is more likely to agglomerate due to ambient heat and moisture (the moisture lowers the fluidity of the developer) and may become solidified.

In contrast, in the present embodiment, the anti-accumulation section 106 is provided to face a section of the developing roller 104, and inside the section of the developing roller 104, no fixed magnetic pole is provided. This makes it possible to curb the occurrence of consolidation and agglomeration of the developer.

In the present embodiment, the anti-accumulation section 106 is formed of ABS resin and is attached to the bottom surface (inner surface) of the developer container 101 by use of an adhesive. However, the material for the anti-accumulation section 106 is not limited thereto, and aluminum, nonmagnetic stainless steel, or the like may be used, for example. If the anti-accumulation section 106 is made of nonmagnetic material, the anti-accumulation section 106 performs no magnetizing effect on the developer. This allows variation in density of the developer caused by the magnetizing effect to be prevented, thereby stabilizing the density of the toner adhered to the developing roller 104 to be carried to the outside of the developer container 101.

The width of the developing roller 104 along the direction in which the peripheral surface thereof extends and the width of the opening of the developer container 101 along the direction parallel to the direction in which the developing roller 104 extends are set to correspond to a maximum width (the width in a direction perpendicular to the carrying direction) of recording paper on which prints can be made by the color printer 1. The doctor blade 105 and the anti-accumulation section 106 are provided across the full width of the opening part of the developer container 101 along the direction parallel to the extending direction of the developing roller 104.

As described above, in the present embodiment, the anti-accumulation section 106 is provided to cover a corner formed between the bottom surface (inner surface) of the developer container 101 and the surface of the doctor blade 105 on the upstream side of the rotation direction of the developing roller 104.

This makes it possible to curb the accumulation of the developer in the proximity of the section where the developer container 101 and the doctor blade 105 abut each other (hereinafter also referred to as abutting section). As such, it is prevented that the density of the developer in the proximity of the abutting section becomes unstable and that the toner adhered to the developing roller 104 is ununiformly carried to the outside of the developer container 101. It is further prevented that the accumulation of the developer causes a temperature of the developer to rise. Therefore, it is possible to form, with a simple configuration, an image of high quality without nonuniform development.

In the present embodiment, the anti-accumulation section 106 is provided such that an angle between the surface of the anti-accumulation section 106 facing the developing roller 104 and the surface of the doctor blade 105 on the upstream side of the rotation direction of the developing roller 104 is larger than an angle between the bottom surface (inner surface) of the developer container 101 and the surface of the doctor blade 105 on the upstream side of the rotation direction of the developing roller 104. However, this is not the only possibility. It is essential at least that the angle between the surface of the anti-accumulation section 106 facing the developing roller 104 and the surface of the doctor blade 105 on the upstream side of the rotation direction of the developing roller 104 is larger than the angle between a circle concentric with a cross section of the developing roller 104 perpendicular to the extending direction of the developing roller 104 and the surface of the doctor blade 105 on the upstream side of the rotation direction of the developing roller 104. As described previously, in the conventional development device, the bottom surface (inner surface) of the developer container is generally configured to have a shape corresponding to the peripheral surface of the developing roller 104, i.e., a shape that is almost concentric with a circular cross section of the developing roller 104 perpendicular to the extending direction of the developing roller 104. Therefore, it is possible to prevent the accumulation of the developer in the proximity of the doctor blade 105 by making the angle between the surface of the anti-accumulation section 106 facing the developing roller 104 and the surface of the doctor blade 105 on the upstream side of the rotation direction of the developing roller 104 larger than the angle between the circle concentric with the cross section of the developing roller 104 perpendicular to the extending direction of the developing roller 104 and the surface of the doctor blade 105 on the upstream side of the rotation direction of the developing roller 104.

Figure 1B:
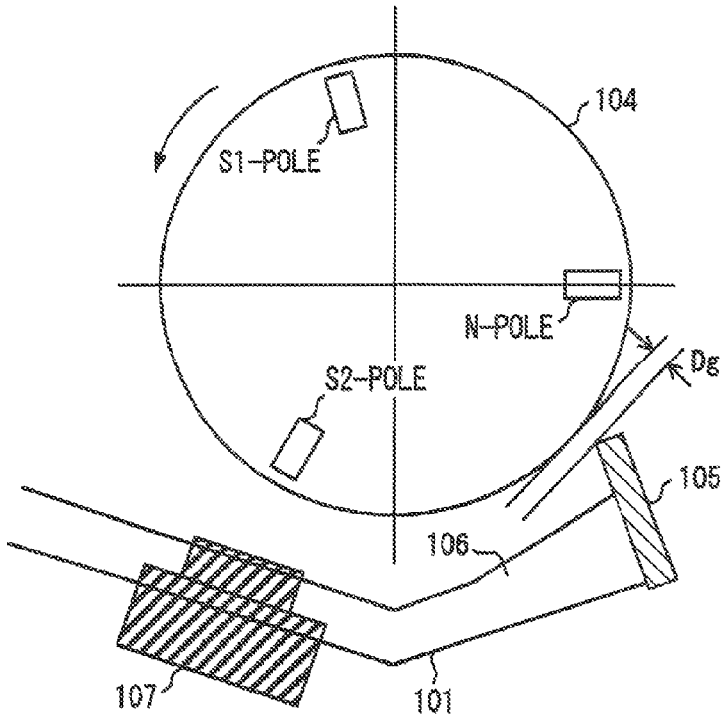

In the present embodiment, it has been described that the anti-accumulation section 106 is a member independent of and attached to the developer container 101, as illustrated in FIG. 1A. However, the configuration of the anti-accumulation section 106 is not limited thereto. In other words, the anti-accumulation section 106 may be integral with the developer container 101, as illustrated in FIG. 1B.

Moreover, it is preferable that the anti-accumulation section 106 be formed such that the distance between the developing roller 104 and the anti-accumulation section 106 becomes smaller toward a downstream side of the rotation direction of the developing roller 104. This makes it possible to prevent abrupt variations in the pressure that acts on the developer due to the rotation of the developing roller 104, thereby more effectively curbing the accumulation of the developer.

(1-3. Experimental Results)

Next, the following will describe results of experiments performed to verify effects produced by provision of the anti-accumulation section 106.

Figure 7:
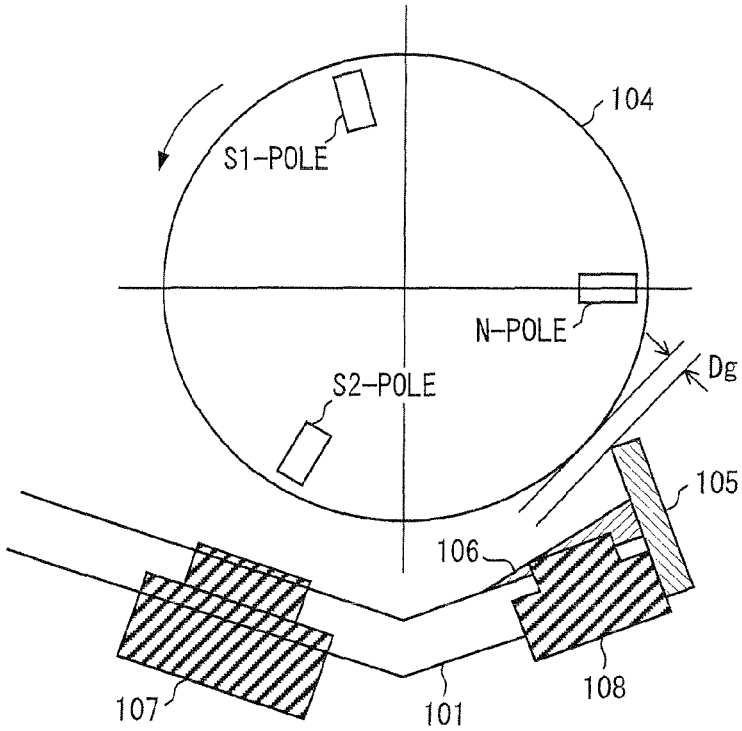
FIG. 7 is a cross-sectional view illustrating an essential part of a developing device according to an example of the present technology.
Figure 8:
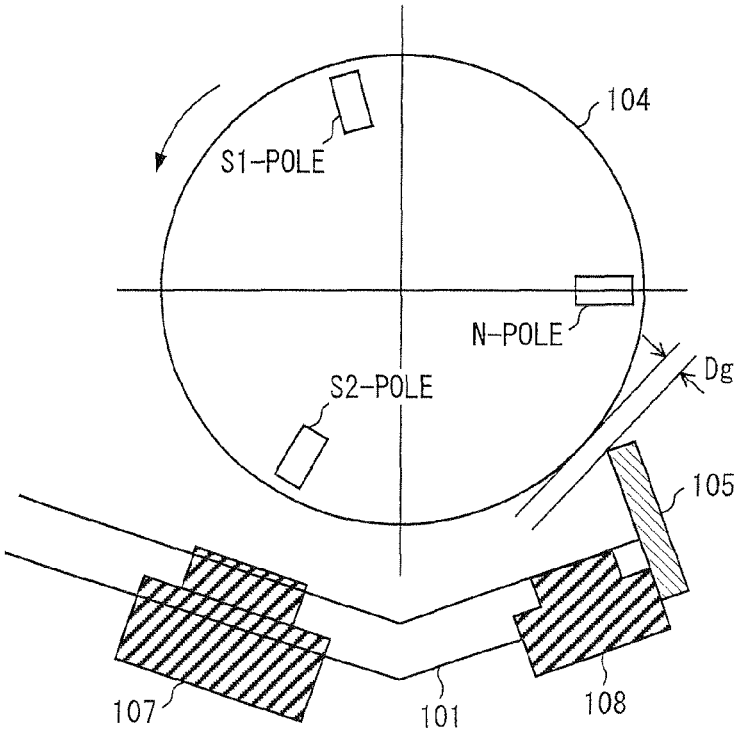
FIG. 8 is a cross-sectional view illustrating an essential part of a developing device according to a comparative example of the present technology.

FIG. 7 is a cross-sectional view of an essential part of a developing device according to an example used in this experiment. FIG. 8 is a cross-sectional view of an essential part of a developing device according to a comparative example used in this experiment. The developing device according to the example has a second toner density sensor 108 at part of the anti-accumulation section 106 in the developing device 51*a* illustrated in FIG. 3. Meanwhile, the developing device according to the comparative example omits the anti-accumulation section 106 in the developing device 51*a* illustrated in FIG. 3, and is provided with the second toner density sensor 108 at the position where the anti-accumulation section 106 used to be provided.

In this experiment, using color multifunction printers MX-7001N manufactured by SHARP Corporation equipped with the developing device according to the example and the developing device according to the comparative example, respectively, test printing was performed on one hundred thousand sheets of A4 sized paper fed in landscape orientation (fed in such a manner that shorter ends of the A4 sized paper sheets were parallel to the direction in which the paper sheets are fed). The rotation speed of the developing roller 104 was set at 350 rpm.

Figure 9:
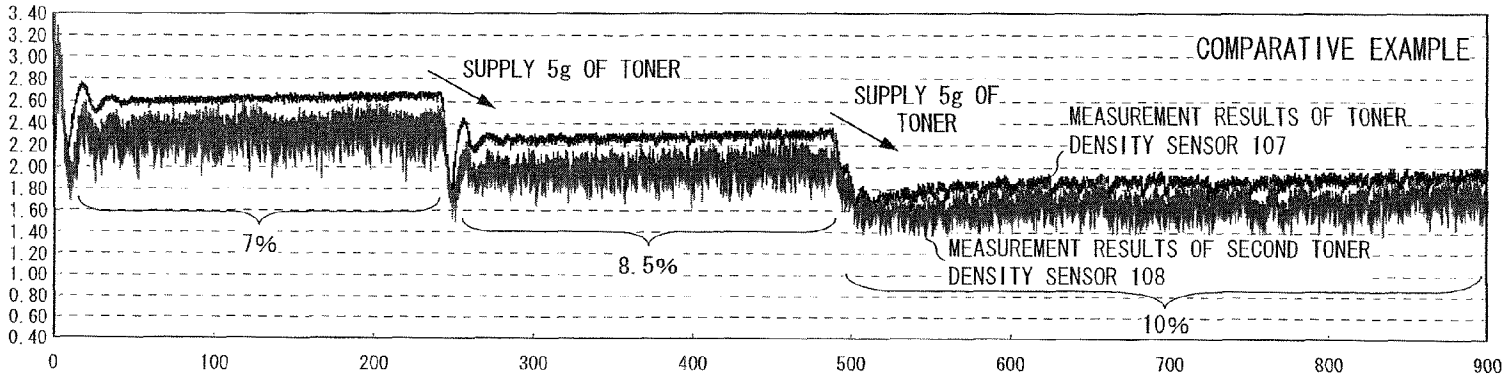
FIG. 9(*a*) is a graph showing results of toner density measurements in the developing device according to the comparative example shown in FIG. 8.
Figure 9:
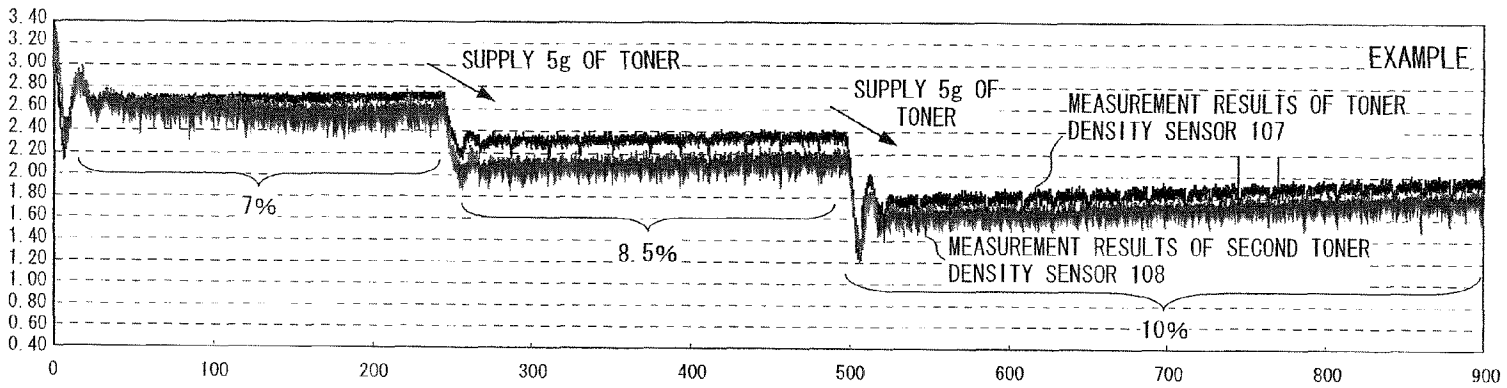

FIG. 9(*a*) is a graph showing results of toner density measurements in the developing device according to the comparative example, and FIG. 9(*b*) is a graph showing results of toner density measurements in the developing device according to the example. In this experiment, toner was intermittently supplied to the developer container 101 in increments of five grams so as to sequentially change the theoretical figure of the toner density from 7% to 8.5%, and then to 10%, while the toner density was consecutively measured by use of the toner density sensor 107 and the second toner density sensor 108.

As is obvious from a comparison between FIG. 9(*a*) and FIG. 9(*b*), the developing device according to the comparative example showed a very wide range of variation in the measurement results of the second toner density sensor 108. This is because the developer accumulated in the proximity of the doctor blade 105 and thereby hampered a flow of the developer. In addition, images formed on the recording materials by the developing device according to the comparative example showed scaly nonuniform images.

In contrast, the developing device according to the example showed a narrower range of variation in the measurement results of the second toner density sensor 108 than that in the comparative example. As is clear from this, the developing device according to the example could reduce the accumulation of the developer in the proximity of the doctor blade 105. In addition, no nonuniform images were observed in images formed on the recording materials by the developing device according to the example. That is, the developing device according to the example was able to form images of high quality.

In addition, after the test printing, a component disposed under the area where the developing device and the photoreceptor drum face each other was checked. While a significant amount of toner was adhered to the component in the developing device according to the comparative example, adhesion of toner to the component was hardly observed in the developing device according to the example.

Figure 10:
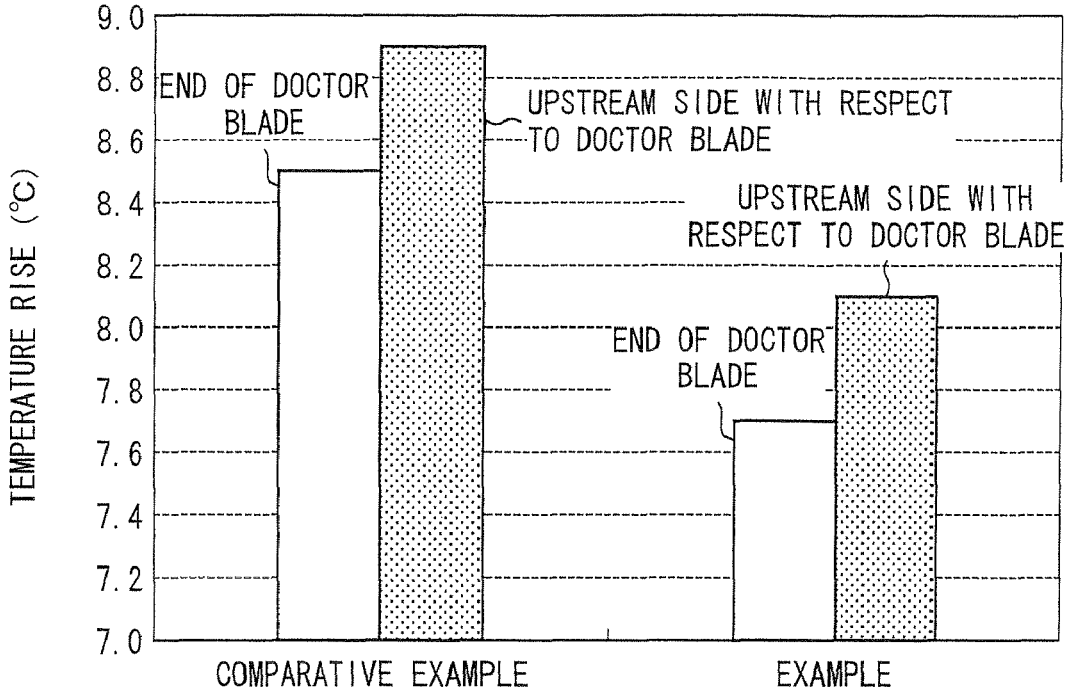
FIG. 10 is a graph showing results of temperature measurements of developer in a developing device according to an embodiment of the present technology. The temperature is measured in a region in the proximity of a doctor blade in a developer container and in a region where the doctor blade and the developing roller face each other.

FIG. 10 is a graph showing results of temperature measurements of the developer. The temperature of the developer was measured in a region in the proximity of the doctor blade 105 in the developer container 101 (a region on the anti-accumulation section 106 in the example, and a region from which the anti-accumulation section 106 was removed in the comparative example) and in the region where the doctor blade 105 and the developing roller 104 face each other. As illustrated in FIG. 10, in a region in the proximity of the doctor blade 105 and in a region where the doctor blade 105 and the developing roller 104 face each other, the temperatures of the developer were respectively higher by about 4° C. in the developing device according to the comparative example than in the developing device according to the example. This is because the accumulation of the developer easily causes heat to be trapped in.

Next, the following will describe results of experiments performed to verify relations between the shape of the anti-accumulation section 106 and the nonuniform development as well as relations between the ambient temperature and humidity and the nonuniform development.

In this experiment, as illustrated in FIG. 11, eight types of examples having anti-accumulation sections 106 with different shapes from each other and Comparative Example 1 which omits the anti-accumulation section 106 were checked as to whether nonuniform images (nonuniform development) occurred when images were formed on recording materials under the following conditions (1) to (3).

(1) Ambient temperature and humidity: Normal temperature and normal humidity (Air temperature: 20° C., Humidity: 60%), Target control value of the toner density: 7%

(2) Ambient temperature and humidity: High temperature and high humidity (Air temperature: 30° C., Humidity: 80%), Target control value of the toner density: 7%

(3) Ambient temperature and humidity: High temperature and high humidity (Air temperature: 30° C., Humidity: 80%), Target control value of the toner density: 8%

The evaluation of the nonuniform development was performed visually: a cross represents a significantly nonuniform development; a triangle represents an obvious nonuniform development; a circle represents a slight but practically problem-free nonuniform development; and a double circle represents no nonuniform development.

Figure 12:
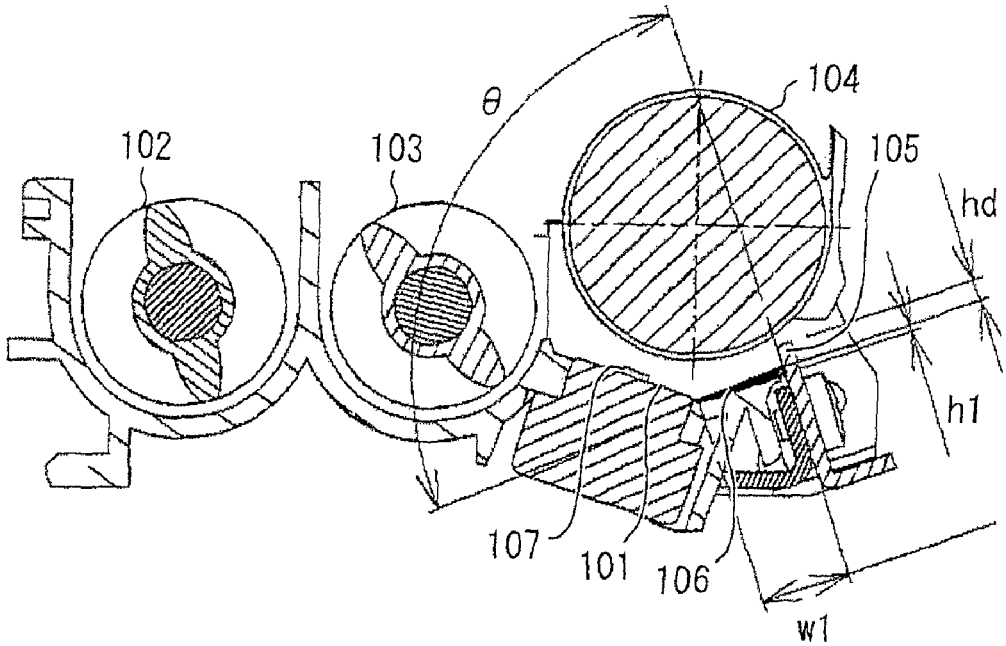
FIG. 12 is a cross-sectional view illustrating a shape of an anti-accumulation section in a developing device according to an embodiment of the present technology.

As illustrated in FIG. 12, "θ" in FIG. 11 represents an angle between a surface of the doctor blade 105 on the upstream-side of the rotation direction of the developing roller 104 (a surface of the doctor blade 105 on the inner side of the developer container 101) and the surface of the anti-accumulation section 106 (on the side facing the developing roller 104); "h1" represents a width (height), which is parallel to the surface of the doctor blade 105 on the upstream side of the rotation direction of the developing roller 104, of the anti-accumulation section 106; "hd" represents a length (height) from the point where the surface of the doctor blade 105 on the upstream side of the rotation direction of the developing roller 104 abuts the anti-accumulation section 106 to the end of the doctor blade 105; and "w1" represents a width of the anti-accumulation section 106 perpendicular to the surface of the doctor blade 105 on the upstream side of the rotation direction of the developing roller 104.

As illustrated in FIG. 11, in the experiments carried out at a normal temperature and humidity with a target control value of the toner density of 7% in the developer container 101, none of the examples exhibited nonuniform development. However, in the experiments carried out at a high temperature and humidity and in the experiments carried out with a high target control value of the toner density, some of the examples exhibited nonuniform development.

Furthermore, in the examples in which the width h1 was set to be in the range from 0.8 mm to 1.5 mm, and the height hd was set to be in the range from 0.7 mm to 1.4 mm, the nonuniform images arising from the accumulation of the developer could be reduced to such an extent that the nonuniform images cause practically no problem. In cases where the height h1 was set to be larger than 1.5 mm (the height hd was set to be smaller than 0.7 mm), the doctor blade 105 could not achieve a sufficient spike cutting effect. As such, in some cases, part of the toner scraped through the doctor gap and was carried to the outside of the developer container 101.

Accordingly, it is preferable that the anti-accumulation section 106 is provided such that the height hd of the doctor blade 105 be set to be in the range from 0.7 mm to 1.4 mm.

As described above, a developing device according to the present technology includes a developer container containing a developer; and a developing roller being provided so that a peripheral surface thereof is partially exposed to an outside of the developer container through an opening provided in the developer container, the developing roller being rotated while the developer contained in the developer container is adhered to the developing roller, so that the developer is carried to the outside of the developer container, the developing roller being rotated in such a manner that the peripheral surface thereof passes close by an end of the opening on a bottom-surface side of the developer container to the outside of the developer container, and passes close by an end of the opening on a ceiling side of the developer container to the inside of the developer container, and the developing device according to the present technology further includes: a doctor blade, provided at the end of the opening on the bottom-surface side of the developer container so as to project from the developer container toward the developing roller, regulating a height of a layer of the developer adhered to the developing roller to be carried, the height being a distance from the peripheral surface of the developing roller; and an anti-accumulation section provided at a corner formed between an inner surface of the developer container and a surface of the doctor blade on an upstream side of a rotation direction of the developing roller, and in the developing device according to the present technology, an angle between a surface of the anti-accumulation section facing the developing roller and a surface of the doctor blade on the upstream side of the rotation direction of the developing roller is larger than an angle between a circle concentric with a cross section of the developing roller perpendicular to a direction in which the developing roller extends and the surface of the doctor blade on the upstream side of the rotation direction of the developing roller at the corner.

According to the above configuration, the anti-accumulation section is provided at the corner formed between the inner surface of the developer container and the surface of the doctor blade on the upstream side of the rotation direction of the developing roller, and the angle between the surface of the anti-accumulation section facing the developing roller and the surface of the doctor blade on the upstream side of the rotation direction of the developing roller is larger than the angle between the circle concentric with the cross section of the developing roller perpendicular to the direction in which the developing roller extends and the surface of the doctor blade on the upstream side of the rotation direction of the developing roller at the corner. This makes it possible to curb the accumulation of the developer dammed by the doctor blade as well as to prevent the occurrence of an unstable density of the developer carried to the outside of the developer container due to uneven passage of the dammed developer through the space between the doctor blade and the developing roller. Furthermore, it is also prevented that the accumulation of the developer causes the temperature of the developer in the proximity of the doctor blade to rise and that the developer thus becomes more likely to be fused to the developing roller. As a result, it is possible to stabilize the density of the developer carried by the developing roller to the outside of the developer container and form an image of high quality with little nonuniform development.

According to the above configuration, the developing roller is rotated in such a manner that the peripheral surface thereof passes close by an end of the opening on the bottom-surface side of the developer container to the outside of the developer container, and passes close by an end of the opening on the ceiling side of the developer container to the inside of the developer container. In this configuration, in comparison with the configuration in which the developing roller is rotated in a counter direction, the developer dammed by the doctor blade, which is provided in the proximity of the end of the opening on a bottom-surface side of the developer container, is particularly likely to accumulate. Nevertheless, the present technology can effectively curb the accumulation of the developer dammed by the doctor blade.

Moreover, the developing device according to the present technology may be configured such that a plurality of fixed magnetic poles are provided inside the developing roller, the plurality of fixed magnetic poles being disposed apart from each other along the rotation direction of the developing roller and not rotating even when the developing roller is rotated, and the anti-accumulation section is provided to face a section of the developing roller, the plurality of fixed magnetic poles being not provided inside the section of the developing roller facing the anti-accumulation section.

With this configuration, it is possible to curb the occurrence of consolidation and agglomeration of the developer from occurring between the developing roller and the anti-accumulation section.

Furthermore, the developing device according to the present technology may be configured such that the anti-accumulation section is provided independently of the developer container and attached to the inner surface of the developer container, and the angle between the surface of the anti-accumulation section facing the developing roller and the surface of the doctor blade on the upstream side of the rotation direction of the developing roller is larger than an angle between the inner surface of the developer container and the surface of the doctor blade on the upstream side of the rotation direction of the developing roller. The anti-accumulation section may also be integral with the developer container.

According to the above configurations, it is possible to curb the accumulation of the developer dammed by the doctor blade as well as to prevent the occurrence of an unstable density of the developer carried to the outside of the developer container due to uneven passage of the dammed developer through the space between the doctor blade and the developing roller. Furthermore, it is also prevented that the accumulation of the developer causes the temperature of the developer in the proximity of the doctor blade to rise and that the developer thus becomes more likely to be fused to the developing roller. As a result, it is possible to stabilize the density of the developer carried by the developing roller to the outside of the developer container and form an image of high quality with little nonuniform development.

The developer may be a two-component developer containing toner and carrier, and the developing device may further include a toner density sensor detecting a toner density in the developer container, the toner density sensor being positioned upstream of the anti-accumulation section along the rotation direction of the developing roller so as to face the developing roller in the developer container.

With this configuration, the provision of the anti-accumulation section makes it possible to curb the accumulation of the developer dammed by the doctor blade. As a result, it is prevented that the accumulated developer causes unstable density of the developer in a region where the toner density sensor measures the toner density. In consequence, the toner density in the developer container can be accurately detected.

The anti-accumulation section may be provided such that a distance between the developing roller and the anti-accumulation section becomes smaller toward a downstream side of the rotation direction of the developing roller.

With this configuration, the distance between the developing roller and the accumulation part monotonically decreases toward the downstream side of the rotation direction of the developing roller. This can prevent the pressure that affects the developer from being drastically changed by the rotation of the developing roller, thereby more effectively curbing the accumulation of the developer.

A length from a point where the surface of the doctor blade on the upstream side of the rotation direction of the developing roller abuts the anti-accumulation section to an end of the doctor blade facing the developing roller may be in a range from 0.7 mm to 1.4 mm.

With this configuration, it is possible to appropriately regulate the height of the layer of the developer, which is adhered to the developing roller to be carried to the outside of the developer container, the height being a distance from the peripheral surface of the developing roller. At the same time, it is possible to appropriately curb the accumulation of the developer in the proximity of the doctor blade in the developer container. That is, if the above-mentioned length is too short, the doctor gap, which is a distance between the end of the doctor blade and the developing roller, becomes too large. This makes it impossible to appropriately regulate the height of the layer of the developer adhered to the developing roller, thereby making the density of the developer passing through the doctor gap unstable. On the other hand, if the above-mentioned length is too long, the doctor gap becomes too narrow. As a result, the developer dammed by the doctor blade is likely to accumulate. However, setting the above-mentioned length within the aforementioned range makes it possible to appropriately regulate the height of the layer of the developer adhered to the developing roller to be carried to the outside of the developer container and to appropriately curb the accumulation of the developer.

The anti-accumulation section may be made from a non-magnetic material.

With the above configuration, the anti-accumulation section performs no magnetizing effect on the developer. This allows variation in density of the developer caused by the magnetizing effect to be prevented, thereby stabilizing the density of the developer adhered to the developing roller to be carried to the outside of the developer container.

An image forming apparatus according to the present technology includes any of the foregoing developing devices. Therefore, the image forming apparatus can form an image of high quality with little nonuniform development.

The present technology is not limited to the description of the embodiments above, but may be altered within the scope of the claims. An embodiment based on a proper combination of technical means disclosed in different embodiments is encompassed in the technical scope of the present technology.

INDUSTRIAL APPLICABILITY

The present technology can be applied to a developing device included in an electrophotographic image forming apparatus and to an image forming apparatus including the developing device.

REFERENCE SIGNS LIST

1 Color Printer (Image Forming Apparatus)
51*a* to 51*d* Photoreceptor Drums (Image Bearing Members)
52*a* to 52*d* Charging Units
53*a* to 53*d* Developing Units (Developing Devices)
56*a* to 56*d* Toner Bottles
101 Developer Container
101*a* Wall
102 First Carrying Screw
103 Second Carrying Screw
104 Developing Roller
105 Doctor Blade
106 Anti-accumulation Section
107 Toner Density Sensor
108 Second Toner Density Sensor
111 Shaft
112 Blade
Dg Doctor Gap

The invention claimed is:

1. A developing device comprising:

a developer container containing a developer; and a developing roller being provided so that a peripheral surface thereof is partially exposed to an outside of the developer container through an opening provided in the developer container, the developing roller being rotated while the developer contained in the developer container is adhered to the developing roller, so that the developer is carried to the outside of the developer container, the developing roller being rotated in such a manner that the peripheral surface thereof passes close by an end of the opening on a bottom-surface side of the developer container to the outside of the developer container, and passes close by an end of the opening on a ceiling side of the developer container to the inside of the developer container, the developing device further comprising:

a doctor blade, provided at the end of the opening on the bottom-surface side of the developer container so as to project from the developer container toward the developing roller, regulating a height of a layer of the developer adhered to the developing roller to be carried, the height being a distance from the peripheral surface of the developing roller; and an anti-accumulation section provided at a location where an inner surface of the developer container meets a surface of the doctor blade on an upstream side of a rotation direction of the developing roller, wherein:

a plurality of fixed magnetic poles are provided inside the developing roller, the plurality of fixed magnetic poles being disposed apart from each other along the rotation direction of the developing roller and not rotating even when the developing roller is rotated, and the anti-accumulation section is provided to face a section of the developing roller, the plurality of fixed magnetic poles being not provided inside the section of the developing roller facing the anti-accumulation section.

2. The developing device according to claim 1, wherein:

the anti-accumulation section is provided independently of the developer container and attached to the inner surface of the developer container, and the angle between the surface of the anti-accumulation section facing the developing roller and the surface of the doctor blade on the upstream side of the rotation direction of the developing roller is larger than an angle between the inner surface of the developer container and the surface of the doctor blade on the upstream side of the rotation direction of the developing roller.

3. The developing device according to claim 1, wherein the anti-accumulation section is integral with the developer container.

4. The developing device according to claim 1, wherein:

the developer is a two-component developer containing toner and carrier, and the developing device further comprises a toner density sensor detecting a toner density in the developer container, the toner density sensor being positioned upstream of the anti-accumulation section along the rotation direction of the developing roller so as to face the developing roller in the developer container.

5. The developing device according to claim 1, wherein the anti-accumulation section is provided such that a distance between the developing roller and the anti-accumulation section becomes smaller toward a downstream side of the rotation direction of the developing roller.

6. The developing device according to claim 1, wherein a length from a point where the surface of the doctor blade on the upstream side of the rotation direction of the developing roller abuts the anti-accumulation section to an end of the doctor blade facing the developing roller is in a range from 0.7 mm to 1.4 mm.

7. The developing device according to claim 1, wherein the anti-accumulation section is made from a nonmagnetic material.

8. An image forming apparatus comprising a developing device according to claim 1.

9. A developing device comprising:

a developer container containing a developer; and a developing roller being provided so that a peripheral surface thereof is partially exposed to an outside of the developer container through an opening provided in the developer container, the developing roller being rotated while the developer contained in the developer container is adhered to the developing roller, so that the developer is carried to the outside of the developer container, the developing roller being rotated in such a manner that the peripheral surface thereof passes close by an end of the opening on a bottom-surface side of the developer container to the outside of the developer container, and passes close by an end of the opening on a ceiling side of the developer container to the inside of the developer container, the developing device further comprising:

a doctor blade, provided at the end of the opening on the bottom-surface side of the developer container so as to project from the developer container toward the developing roller, regulating a height of a layer of the developer adhered to the developing roller to be carried, the height being a distance from the peripheral surface of the developing roller; and an anti-accumulation section provided at a location where an inner surface of the developer container meets a surface of the doctor blade on an upstream side of a rotation direction of the developing roller, wherein:

the developer is a two-component developer containing toner and carrier, and the developing device further comprises a toner density sensor detecting a toner density in the developer container, the toner density sensor being positioned upstream of the anti-accumulation section along the rotation direction of the developing roller so as to face the developing roller in the developer container.

10. The developing device according to claim 9, wherein:

the anti-accumulation section is provided independently of the developer container and attached to the inner surface of the developer container, and the angle between the surface of the anti-accumulation section facing the developing roller and the surface of the doctor blade on the upstream side of the rotation direction of the developing roller is larger than an angle between the inner surface of the developer container and the surface of the doctor blade on the upstream side of the rotation direction of the developing roller.

11. The developing device according to claim 9, wherein the anti-accumulation section is integral with the developer container.

12. The developing device according to claim 9, wherein the anti-accumulation section is provided such that a distance between the developing roller and the anti-accumulation section becomes smaller toward a downstream side of the rotation direction of the developing roller.

13. The developing device according to claim 9, wherein a length from a point where the surface of the doctor blade on the upstream side of the rotation direction of the developing roller abuts the anti-accumulation section to an end of the doctor blade facing the developing roller is in a range from 0.7 mm to 1.4 mm.

14. The developing device according to claim 9, wherein the anti-accumulation section is made from a nonmagnetic material.

15. An image forming apparatus comprising a developing device according to claim 9.

* * * * *